United States Patent [19]

Kelly

[11] 4,122,559

[45] Oct. 31, 1978

[54] SHOWER SCREENS

[76] Inventor: David B. Kelly, "Overwood", Wood La., Off Overdale Rd., Willaston-in-Wirral, Cheshire, England

[21] Appl. No.: 781,824

[22] Filed: Mar. 28, 1977

[30] Foreign Application Priority Data

Apr. 3, 1976 [GB] United Kingdom ..... 13581/76
Jun. 25, 1976 [GB] United Kingdom ..... 26480/76

[51] Int. Cl.[2] ..... A47K 3/14; A47K 3/22

[52] U.S. Cl. ..... 4/149; 4/153; 4/154; 160/11

[58] Field of Search ..... 4/1, 154, 153, 149, 4/172.12, 172.14; 160/11

[56] References Cited

U.S. PATENT DOCUMENTS

| | | | |
|---|---|---|---|
| 1,898,233 | 2/1933 | Woods | 4/149 |
| 2,120,155 | 6/1938 | Shera | 4/154 |
| 2,131,156 | 9/1938 | Yardley | 4/154 X |
| 2,481,397 | 9/1949 | Dalton, Jr. | 4/149 |
| 2,756,438 | 7/1956 | Soberman | 4/149 |
| 2,840,827 | 7/1958 | Calvano | 4/149 |
| 3,110,343 | 11/1963 | Guffan | 160/11 |
| 3,222,689 | 12/1965 | Efron et al. | 4/149 |
| 3,582,998 | 6/1971 | Morse | 4/154 |
| 3,639,919 | 2/1972 | White | 4/149 |
| 3,747,132 | 7/1973 | Foster | 4/172.14 |
| 3,952,337 | 4/1976 | Hanson | 4/154 |
| 3,965,960 | 6/1976 | Massey | 160/11 X |

*Primary Examiner*—Henry K. Artis
*Attorney, Agent, or Firm*—Fred Philpitt

[57] ABSTRACT

The present specification describes and claims a shower screen unit. The unit basically comprises a roller blind of, for example, woven glass fiber material, housed in an elongate extruded plastics material casing. Two freely rotatable water absorbent sponge rollers are also housed in the casing and the screen passes therebetween, the rollers engaging opposite sides of the screen. The unit can be secured in position by an adhesive sponge layer on the casing and can be decorated by a detachable valance. The lower edge of the screen is divided for use in gripping a wall defining part of a shower area.

27 Claims, 10 Drawing Figures

FIG 2
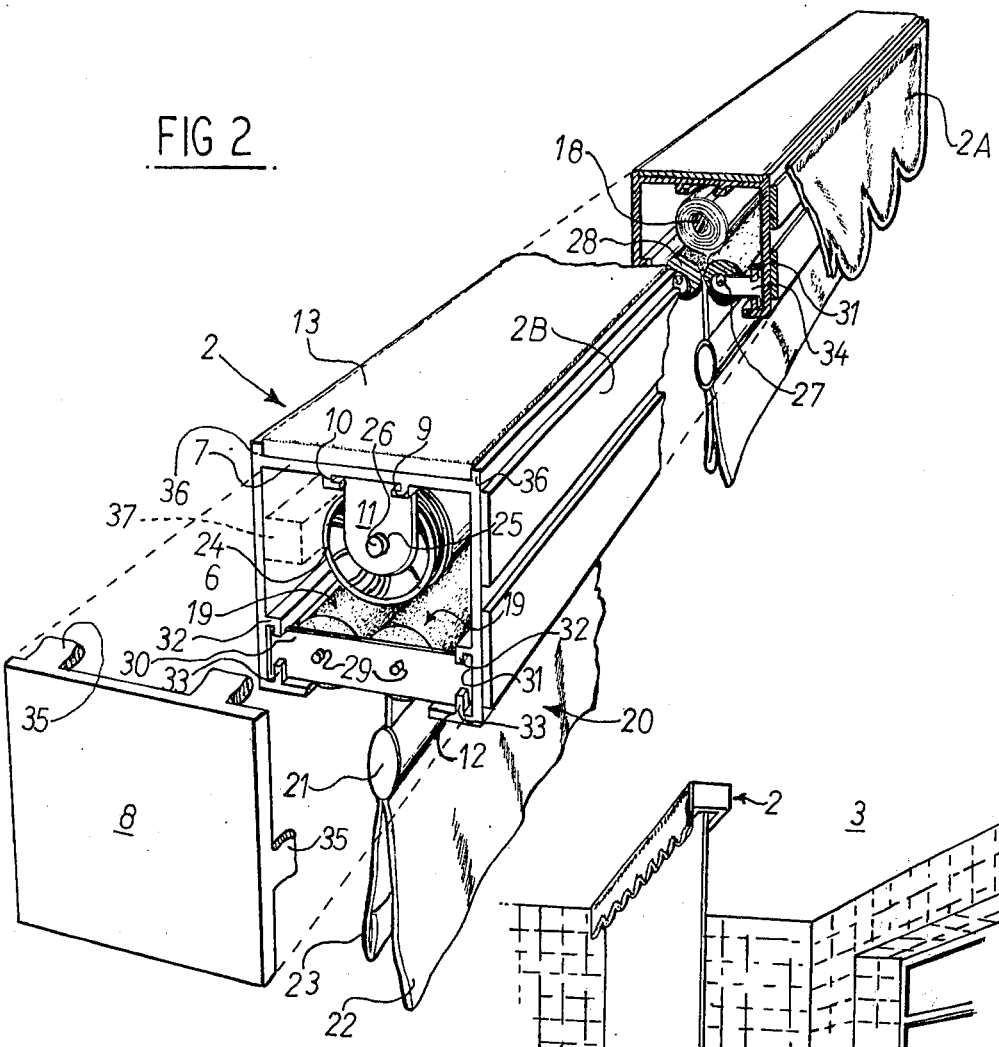
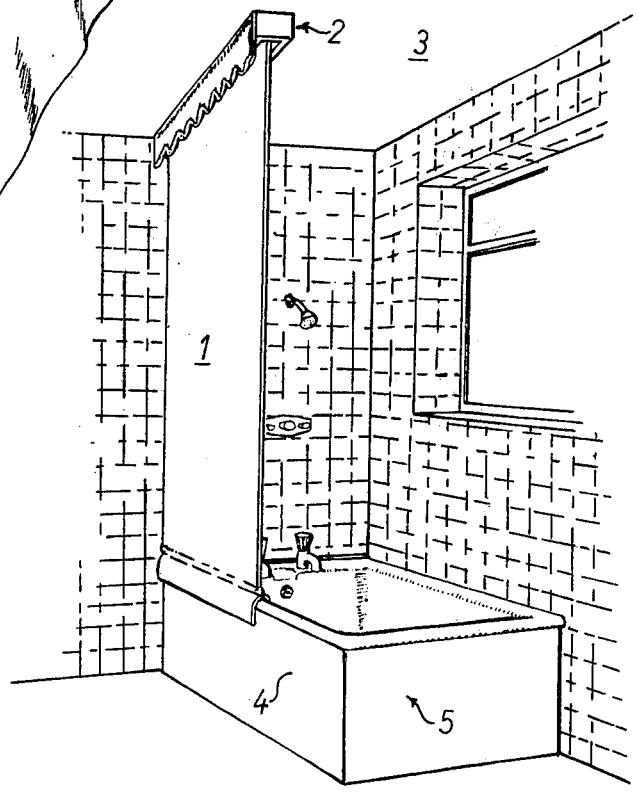
FIG 1

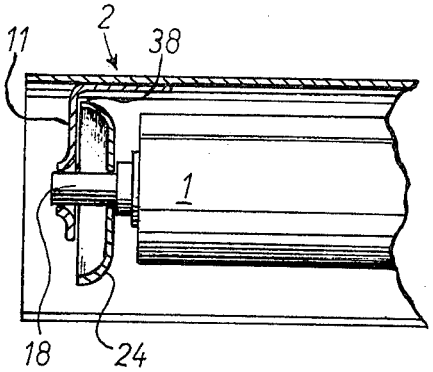
FIG 5
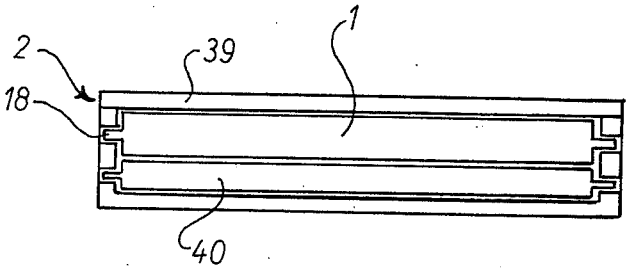
FIG 6
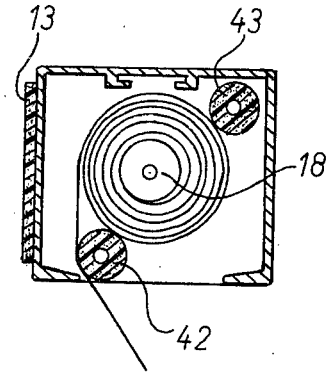
FIG 7
FIG 3
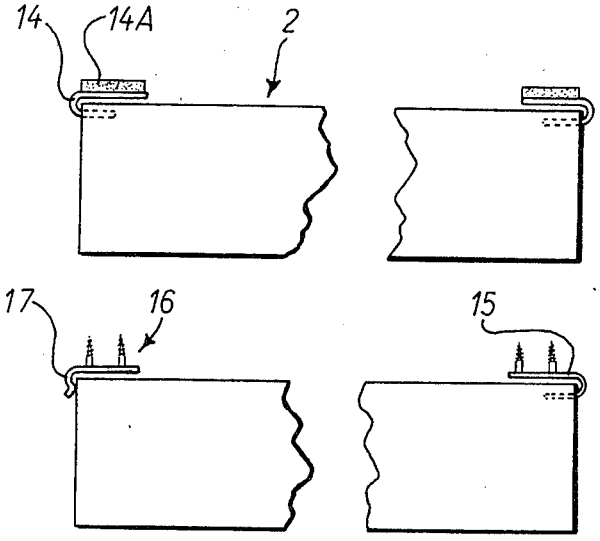
FIG 4

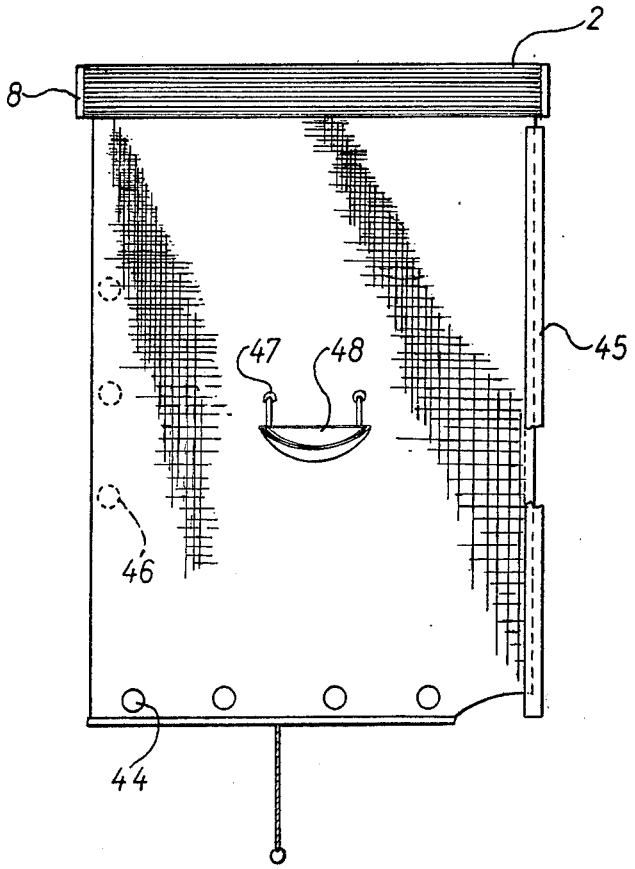
FIG 8
FIG 9
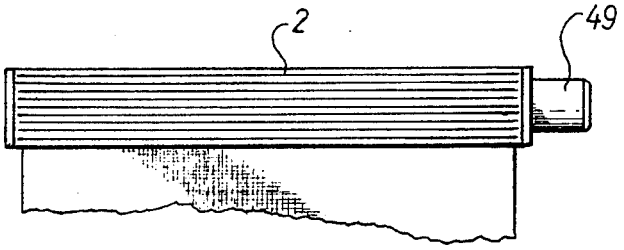
FIG 10
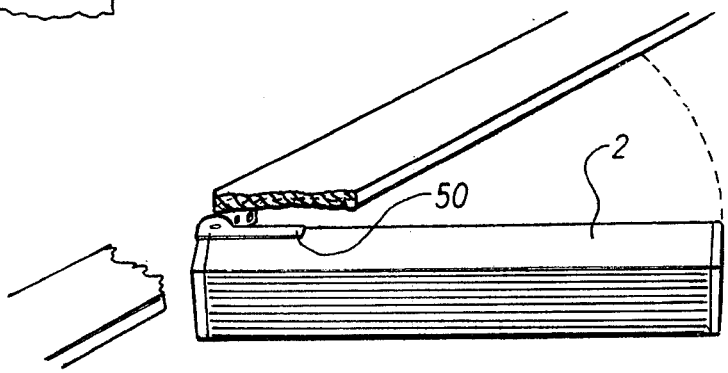

SHOWER SCREENS

The present invention relates to a shower screen unit for use with a bath or shower tray.

Various types of shower enclosure or screen are already known. However, these enclosures or screens usually require either a door or curtain by which a person can enter the shower.

The doors used to date on a shower have either a rigid frame with a glass and plastics material panel or are of the folding type and usually made of a pliable plastics material. The various doors tend to be expensive and the cheapest of these requires a bottom channel either as a rebate with a hinged door or as a guide with a folding or concertina door. The channel is both ugly and cumbersome.

The shower curtain is a simple form of closure and can be effective. However, there is always the problem of matching colour and parking the curtain in an unobstrusive spot which through necessity has to be above the shower tray or bath. In use the curtain is drawn to close off the shower area, the bottom of the curtain being located within the bath or shower tray to retain the water within the shower area.

When providing either a door or curtain for a shower area a supporting structure has to also be provided. In the case of a door, at least one accurately located doorpost has to be provided and the door has to be accurately hung to provide the required virtually waterproof fit. In the case of a shower curtain, curtain rods or rails of a desired type have to be installed over the shower area.

A simpler type of shower screen unit has, however, also been proposed and this unit basically comprises a roller shaft to which an end region of an elongate sheet of material is attached. The roller shaft is supported in a substantially horizontal position above an edge of, for example, a bath and is rotatable about its longitudinal axis so that the elongate sheet of material can be rolled up on the roller shaft when not in use or unrolled to close off a shower area. It is this simpler type of shower screen unit to which the present invention relates.

In one known form of this simpler type of shower screen unit the roller shaft is mounted within an elongate casing which is constructed of a number of interconnected sections and has a generally inverted U-shaped transverse cross-section. The roller shaft is rotatably mounted on brackets bonded to the top of the inverted U-shaped cross-section and an elongate sheet of any suitable material which is not subject to the deleterious effects of water, soap detergent, mildew etc. is attached to the roller shaft, the roller shaft and the sheet of material taking the form of known roller blind assembly commonly used to cover window areas. In use, the elongate casing is installed between two facing walls using adjustable brackets, vertical guides preferably sealed to the facing walls, serving to guide the edges of the sheet of material as it is unrolled and extended downwards. This arrangement thus completely seals off the shower area. However, whilst taking some considerable time to construct from the various component parts it also requires some considerable time to initially install, including drilling and suitably adjusting the supporting wall brackets.

When this known form of the simplest type of unit is installed and, in use, water necessarily splashes against or flows onto the inside surface of the material forming the screen. Due to surface characteristics of the screen itself and also because of surface tension phenomena, after a person has finished his or her shower, the water drains from the surface of the screen very slowly and incompletely, and a certain amount of water remains on the screen for an extended period of time. If the screen were retracted onto the roller shaft carrying this water, the water would interfere with the proper coiling of the screen on the roller shaft and appreciable quantities of water would collect between the coils of the screen and at the location between the vertical part of the screen and the rolled part; this latter collection of water dripping and draining away to the outside of the shower area. To overcome this problem it has been previously proposed to provide a stationary wiper or squeegee which is fixed in the casing and which bears against the shower enclosure side of the screen, across the full width of the screen, to wipe or strip excess water from the surface of the screen as the screen is retracted onto the roller shaft in the casing. The wiper or squeegee is formed of a plastics material, rubber, fabric, wood or Nylon (R.T.M.) pile. It has been proposed to have squeegees or wipers on both sides of the screen to sandwich the screen, or to pass the screen between a pressure roller and a wiper or squeegee. However, whilst these squeegee or wipers strip the water from the screen and allow the screen to coil up correctly on the roller shaft, there are certain inherent problems.

The main problem is that whilst the wiper or squeegee will strip the water from the shower enclosure side of the screen, this water, as the screen approaches its fully retracted position, is scattered and can and does to a certain extent, escape to the outside of the shower area requiring subsequent mopping up. This problem has previously been noted and one suggested solution has been the provision of a channel along the lower edge region of the screen, the water collected in this channel being drained away, as the screen approaches the fully retracted position, via ducts in vertical guides which retain the side edges of the screen. However, a certain quantity of water is still randomly scattered by the wiper or squeegee.

Further problems which result from the use of wipers or squeegees arise from wear to the screen and/or the wipers or squeegees, and the fact that a stronger spring is required for retracting the screen than in the case where no wipers or squeegees are used. This stronger spring is required due to the frictional drag between the screen and wipers or squeegees and with a stronger spring come the problems of larger construction and greater cost.

Further, the wipers or squeegees wear away relatively quickly and necessitate the expense of new parts and fittings if efficient operation is to be maintained.

The aim of the present invention is to provide a shower screen unit which at least reduces the effect of the above mentioned problems, the unit being simply and easily assembled and disassembled, requiring little or no maintenance and being simple and exceptionally quick to install, requiring no technical skills.

According to the present invention there is provided a shower screen unit comprising an elongate casing which is, in use, mounted horizontally, a roller shaft being rotatably mounted within the casing, one side of a generally rectangular sheet of material being attached to the roller shaft so that as the roller shaft is rotated, the material which, in use, depends through an elongate opening in the casing, is rolled up or unrolled, at least one freely rotatable water absorbent roller being also mounted within the casing parallel to the roller shaft, the roller shaft and the water absorbent roller being relatively arranged so that the material is pressed against the water absorbent roller as it is retracted into the casing.

When a shower screen unit in accordance with the present invention is installed and has been used, the screen may be retracted in the casing, the shower enclosure side of the screen passing over the water absorbent roller which rotates with the movement of the screen, the water from the screen surface being absorbed by the water absorbent roller to thus allow the screen to be correctly rolled onto the roller shaft. As the water absorbent roller actually absorbs the water there is no scattering of the water droplets and as the water absorbent roller rolls with the movement of the screen there is no wear of the screen surface or of the engaging surface of the roller. This thus reduces the maintenance required for the unit and also improves the performance of the unit.

The preferred location for a unit according to the present invention, is on the ceiling and it is a known fact that a ceiling area acts as a heat trap, the difference in temperature between floor and ceiling regions in a bathroom, ranging from 5° to 8° F. Thus it has been found that the natural convection currents do dry the rollers relatively quickly. Alternatively, drying can be effected by electrical heating or enforced air currents, suitable means being then provided in the unit.

In a preferred embodiment of the present invention the casing is made of a plastics material e.g. polyvinyl chloride, the major part of the casing being constructed by extrusion, the extrusion being cut to the desired length and injection moulded or stamped out end caps being clipped, bonded or welded in place to complete the casing. In the extrusion process ribs are formed on the inner wall surfaces of the casing, the ribs while strengthening the casing, being designed to form channels into which brackets can be engaged for supporting the roller shaft and the or each water absorbent roller.

In this preferred embodiment of the present invention the casing has an inverted U-shaped transverse cross-section, ribs in the top of the casing forming a channel for brackets for supporting the roller shaft. The roller shaft and screen take the form of a window roller blind, the screen being made of glass fibre material. Alternatively, the screen may be retracted by a motor counterweight and any material may be used for the screen provided it is not affected by water, soap etc.. i.e., provided it is waterproof, water repellent or does not absorb water or steam, or does so to a minimum extent. Two water absorbent rollers are provided in this preferred embodiment, each roller comprising a number of cylindrical plastics sponge sectons mounted on an aluminium shaft. Alternatively a single sponge section can form each roller. Further, the shaft may alternatively be made out of any other suitable rigid material e.g. a plastics material. The sponge sections may also be of alternative material e.g. rubber, though preferably they are protein free to prevent the multiplication of any bacterial life. Any other suitable absorbent material may of course replace the sponge sections. The two water absorbent rollers are arranged parallel and in contact with each other, the screen passing therebetween. The rollers whilst being rotatable, may be fixed or one or both may be spring biased towards the other. In an alternative embodiment only one water absorbent roller is provided, this roller being offset with respect to the said roller shaft so that the screen is drawn over the water absorbent roller.

To secure the unit of the present invention to a ceiling or other horizontal surface adhesive means are preferably provided on the top of the casing. Alternatively the adhesive means can be provided on another face of the casing for securing the unit to a wall or other substantially vertical surface. The adhesive means is preferably in the form of a sponge layer impregnated with one or more resins which provide the necessary adhesion both to the unit and to a supporting flat surface. One such adhesive means is sold under the Trade Mark 'Cling-Tac'. Using this preferred form of adhesive means the adhesive layer can be applied to the unit either during manufacture or by a purchaser, and the unit can be quickly and easily installed, as and when required, in position on for example a bathroom ceiling, by merely pressing the unit against the ceiling. An adhesive layer may be provided along the full length of the casing or at spaced apart locations. Alternatively brackets which engage the end regions of the casing may be screwed into position or provided with adhesive for securing the unit in a desired position. Brackets may be used when the support surface is rough, the adhesive means along the full length of the casing being thus inappropriate.

As opposed to securing the unit to a ceiling or any other fixed flat surface, the unit of the present invention can alternatively be hingedly supported at one end to, for example, a wall so that when it is not in use the unit can be hinged to a position against the wall underneath, for example, a fixed shelf. As an alternative to hinging the actual unit to the wall the unit may be secured to a hinged arm.

With the preferred embodiment of the present invention in use, with for example a conventional generally rectangular bath which is already enclosed on three sides i.e., two shorter sides and one longer side, by walls, the shower screen unit is preferably secured to the ceiling above the other longer edge of the bath. When the shower is to be used the person taking the shower pulls down i.e., unrolls, the screen and uses attachment means to secure the lower end region of the sheet material to the bath. Preferably said attachment means is formed by a divided or split end whereby one part of the free end region engages for example, the inside wall of the bath whilst the other part engages the outside wall of the bath. The free end region of the sheet material thus straddles the edge of the bath preventing the screen from flapping around whilst preventing the egress of water from the shower area. To add aesthetic appeal to the unit the divided free end region can be provided with any desired decoration e.g. a fringed and/or scalloped edge.

An alternative means for detachably attaching said other end region to a bath or shower base are flexible suckers by means of which the free end region of the screen can be adhered to the inside wall surface of a bath or shower tray.

It will be appreciated that with a unit attached to a ceiling above, for example, a bath, a large drop is required for the screen to the bath edge e.g. 7–8ft. This presents problems as it is a known disadvantage of roller blinds, especially large i.e., long blinds, that unless the blind is pulled substantially vertically downwards prior to its release for retraction, the blind will, when released, often roll up on one end of the roller shaft and jam against the bracket supporting that end of the roller blind, before the blind is fully retracted. To overcome this problem a preferably cup-shaped washer member is freely rotatably mounted on each end of the roller shaft of the shower screen, this washer member when engaged by a side edge of a retracting blind, rotating with the blind due to the frictional engagement, and biassing the blind towards the desired central position.

Whilst a shower screen unit according to the present invention may be so dimensioned to close off, for example, the whole side of a bath and the side edges of the screen may be guided in fixed guides, it has been found sufficient for the unit merely to close off approximately half the side of a bath adjacent the shower head.

During the extrusion of the casing the outer faces or the outer face of at least one of the long side walls of the casing can be decorated with one or more grooves of any desired depth, and, immediately subsequent to the extrusion process patterns can be embossed on the casing, to improve the aesthetic appeal of the unit. Alternatively, a decorative sheet of material e.g. fringed or scalloped, of the same material as the screen or of any other desired material can be attached to the front of the casing before or after installation of the unit. This decorative sheet can be attached to the casing by any suitable means e.g. studs or adhesive.

The present invention will now be further described, by way of example, with reference to the accompanying drawings in which:

FIG. 1 illustrates a shower area formed by a bath wherein one embodiment of the present invention is in a position ready-for-use, FIG. 2 is an enlarged, perspective, partially exploded and cutaway view of the embodiment in FIG. 1, FIGS. 3 and 4 are schematic cross-sections of the casing of the embodiment in FIGS. 1 and 2 illustrating alternative means for securing the unit in position.

FIG. 5 is a cutaway view of one end of the unit in FIGS. 1 and 2, showing the arrangement of the cup shaped washer members, FIG. 6 is an inverted plan view of a further embodiment of the present invention, FIG. 7 is a transverse cross-sectional view of a still further embodiment of the present invention, FIG. 8 is a frontal view of a still further embodiment of the present invention, FIG. 9 is a frontal view of a still further embodiment of the present invention utilising motor means for operating the screen; and FIG. 10 illustrates an alternative form of support for a shower screen unit constructed in accordance with the present invention.

A preferred embodiment of a shower screen unit constructed in accordance with the present invention is illustrated in FIG. 1, ready for immediate use with a conventional generally rectangular bath 5. The shower screen unit comprises a screen 1 which is retractable into a casing 2 which is secured to the ceiling 3. The casing 2 is elongate and is so arranged that its longitudinal axis lies in a vertical plane which includes or is adjacent to an inner wall surface of longer side 4 of the bath 5.

As can be seen from FIG. 2 of the accompanying drawings, the casing 2 is a rectangular box the bottom face of which is open to allow the screen 1 to pass therethrough. The casing 2 is made of polyvinyl chloride, the longer sides 6 and top 7 being integrally formed by extrusion and rectangular end pieces 8 completing the box structure. Within the casing 2, the top 7 is provided with two longitudinally extending thickened portions 9 which are shaped together to form a channel 10 in which brackets 11 are retained (only one bracket 11 is illustrated) at each end of the casing. These thickened portions 9 also add to the rigidity of the casing 2.

The lower edges of the sides 6 of the casing are provided with inwardly extending portions 12 which extend the length of the casing and also add to the rigidity of the casing 2. The casing 2 may be made in any desired colour of polyvinyl chloride to thus match the decor of a particular shower area, though alternatively it may be painted or otherwise decorated when in situ.

Further to increase the aesthetic appeal of the unit the sides of the casing 2 can be embossed or provided with decorative ridges. Alternatively a pelmet or valance 2A of any desired material and decorative design, can be attached to the front face of the casing 2. As can be seen in FIG. 2, the pelmet 2A can be adhered to the casing by adhesive layers 2B. Alternatively, the pelmet 2A may be attached by any other suitable means e.g. studs or Velcro fastening. Thus the pelmet 2A can be easily detached for cleaning or replacement. Whilst the casing 2 is described hereabove as being a P.V.C. extrusion the casing may alternatively be constructed from any other suitable plastics material by any desired method or from any other suitable rigid material e.g. Aluminium. Further, whilst the above described casing is an elongate member having a rectangular cross-section, a casing may alternatively be used which has any desired cross-section provided it has an opening extending along the length thereof to allow the screen 1 to pass therethrough.

As seen in FIG. 2 a layer 13 of adhesive is provided along the upper surface of the top 7 of the casing 2 to enable the unit to be attached to a ceiling. The adhesive layer 13 is sponge impregnated with an adhesive. However, alternatively any other suitable adhesive layer may be substituted. Whilst in FIG. 2 the adhesive layer extends the full length of the casing, adhesive may alternatively be only provided at spaced apart locations or, as shown in FIG. 3 brackets 14 may be provided at each end of the casing, the brackets each engaging in channel 10 and being provided with an adhesive section 14A. As an alternative to an adhesive any other suitable means e.g. toggle bolts (see FIG. 4) or a first fixed guide channel, can be used to secure the brackets or the actual unit in position. When the brackets are first bolted to the ceiling or other desired support surface (see FIG. 4), one bracket 15 is constructed so as to be engaged into one end of channel 10 in the casing and the other bracket 16 has a resilient arm 17 so that by pivoting the casing about bracket 15 and deflecting arm 17, the casing can be snapped into position. This is especially suitable for confined areas where adhesive is inappropriate.

Within the casing 2 (see FIG. 2) are arranged a roller shaft 18 and two sponge rollers 19. One end of the screen 1 is attached to the roller shaft 18, the roller shaft 18 and screen 1 forming part of a roller blind assembly which is, as with commonly used window roller blinds, spring biassed, towards a rolled up or retracted position. The commonly known spring and ratchet mechanism for effecting the locking and spring biassing of a roller window blind assembly is incorporated in this embodiment of the present invention but has not been illustrated.

The screen 1 is made of glass fibre material which is self coloured and translucent. If desired the screen may alternatively be patterned or plain and be transparent or opaque. Further, the screen may be alternatively constructed of a plastics material, the only criterion being that the screen is resistant to water or steam absorption. The lower edge region 20 of the screen 1 is provided with a stiffening bar 21 and attachment means in the form of a divided end region 22,23. Attached to the stiffening bar 21 is a cord 23 for drawing the screen from the casing 2. In use, with the screen unrolled, the end portion 23 is located on the inside of the bath (see FIG. 1) and end portion 22 is located outside the bath. Thus the end region of the screen straddles the edge of the bath to prevent the screen from flapping around and to more effectively seal the shower area against the egress of water. The more readily seen end portion 22 can be decorated for aesthetic appeal either by pattern, or by applying a fringe or scalloped or otherwise shaped edge. Anti-jamming cup-shaped washers 24 are freely rotatably provided on each end of the roller shaft 18 (see FIGS. 2 and 5) and the roller shaft 18 is supported in the casing by brackets 11. Each bracket 11 has lateral projections which allow the brackets to be slid into and retained by the channel 10 formed by thickened portions 9, the brackets each having a hole 25 into which an end 26 of the roller shaft 18 can engage. The two sponge rollers 19 are arranged parallel to each other and to the roller shaft 18. They each comprise an aluminium shaft 27 on which a number of sponge sections 28 of annular cross-section are freely rotatably located. The sponge sections are of a non-protein plastics material which will not support the production of bacteria. The aluminium shaft 27 may of course be replaced by a shaft of any suitable rigid, non-rusting material e.g. a plastics material. The ends of the aluminium shaft 27 engage in holes 29 in two end brackets 30 (only one of which is evident in FIG. 2), the holes 29 being so spaced apart that the sponge sections of the respective rollers contact each other; the screen being sandwiched therebetween. Each bracket 25 is an elongate member having opposite end regions suitably dimensioned and spaced apart to engage in channels 31 formed by ribs 32 and 33 on the inner surfaces of walls 6 of casing 2. The ribs 32 and 33 are formed during the extrusion of the casing 2 and besides supporting the brackets 30 also add to the rigidity and strength of the casing 2. To further support the sponge rollers 19, brackets 34 are provided in the channels 31 these brackets 34 supporting the aluminium shaft 27 approximately in the middle of its length between adjacent sponge sections 28 and thus preventing the sponge rollers from flexing as the screen is extended.

From the above described construction it will be evident that the shower screen unit can be easily and quickly assembled once the extruded casing has been trimmed to the desired length and an appropriate length roller blind assembly selected. First of all brackets 11 are engaged in each end of channel 10 and washers 24 are located on each end 26 of roller shaft 18. The ends 26 are then located in holes 25 in the respective brackets 11, these brackets 11 being slid along channel 10 to the desired position frictional contact retaining the brackets in this position. Then brackets 30 and 34 are located as shown in FIG. 2 in the channels 31 and the sponge rollers 19 are engaged also as shown. The end caps 8 are then clipped into each end of the casing using resilient tabs 35. Alternatively or additionally the end caps 8 can be bonded or welded in position.

With the unit assembled and ready for installation, the adhesive layer 13 which has a protective cover, is exposed and the unit is engaged against the ceiling 3, pressure being applied until upstanding ribs 36 engage the ceiling 3, the unit being then square on the ceiling. The ribs 36 also add to the rigidity of the casing and facilitate the location of the adhesive layer 13 on top 7, it being possible for the adhesive layer to be sold separately and secured to the casing by a purchaser. The pelmet 2A can then be located in position and can, if desired, extend beyond the end of the screen unit.

In use, the screen is pulled downwards and the end portions 22,23 are located so as to straddle the bath edge, the roller blind mechanism retaining the screen in this position. When the screen is subsequently retracted the screen is drawn by the roller blind mechanism between the sponge rollers 19, the sponge rollers rotating with the movement of the screen 1 and absorbing the moisture from the screen. Normally the sponge rollers 19 will be left to dry naturally i.e. to be dried by convection currents in the bathroom. However, if desired, drying means for these rollers can be additionally provided. The drying means can take the form of electrical heating means or may be by way of warm air ducting (see dashed outline 37 in FIG. 2).

As can be seen from FIGS. 2 and 5, the cup-shaped washer members 24 are each located on the roller shaft 18 between the screen 1 and a bracket 11. Thus, as the screen is retracted after a downward releasing movement angled to the vertical, any tendency of the screen to roll up towards one or other end jam against a bracket 11 before it is fully retracted, is reduced due to the edge of the screen contacting a washer 24 which rotates with the screen and biasses the screen to the desired central position away from brackets 11. Each washer 24 only has a small surface re-edge 38, which engages bracket 11. Thus the washer can effectively freely rotate with the retracting screen even when the edge 38 is engaged against a bracket 11.

The above described embodiment of the present invention is of course the preferred embodiment. However, many variations and modifications are of course possible within the scope of the present invention. Some such variations and modifications are illustrated in FIGS. 6 to 10.

In FIG. 6 a sponge member 39 is fixed to one of the inner wall faces of the casing 2 so as to just contact the screen surface as the screen is rolled up. Alternatively this sponge drying member may be spring biassed against the roller blind. Also provided is a freely rotatable sponge roller 40 which is freely rotatably mounted on an axle extending parallel to the axis of the roller shaft 14, the sponge roller 40 being spring biassed into contact with the roller blind so that as the screen is rolled up the roller 40 rotates absorbing water from the screen surface. In an alternative embodiment (not illustrated) the roller 40 is motor driven thus aiding the rolling up of the screen and if the roller 41 rotates faster than the rolling up of the screen, it aids the water absorption from the screen.

In the embodiment of FIG. 7 one freely rotatable sponge roller 42 is provided. This roller is offset so that screen 1 is drawn over this water absorbent roller. As shown in dashed lines a further water absorbent roller 43 can be spring biassed into contact with the screen surface as it is rolled about the roller shaft 18.

An alternative means for attachment of the screen tc a bath or shower base is shown in FIG. 8. This takes the form of a series of flexible rubber suckers 44 provided at spaced apart locations across the width of the screen adjacent the lower edge of the screen. To guide the side edges of the screen in this embodiment or in any other of the above described embodiments, elongate guides 45 are provided. These guides 45 can be merely elongate channels or captive channels wherein, for example, lapped or stitched side edges of the screen are retained. Alternatively, as shown in dashed lines, flexible suckers 46 can be provided along the side edges of the screen to secure said screen to walls of the shower area, which said side edges overlap.

Further, attachment means in the form of holes 47 are provided at a suitable location in the screen 1 for use in supporting soap tray 48 which is detached when the screen is to be retracted. These attachment means can take any suitable form e.g. flexible or hinged hooks and whilst only described with reference to the embodiment of FIG. 8, may be used in any of the embodiments possible within the scope of the present invention.

Whilst the above described embodiments of the present invention utilise a roller screen which operates in an identical manner to a retractable window blind, alternatively the roller shaft may be connected to an electric motor 49 (see FIG. 9) which can be operated as desired, to roll up or unroll the screen. Further, the sponge rollers may likewise be driven either by alternative means or by gearing with the said electric motor.

Whilst the shower screen unit of the present invention is described hereabove as being for attachment to a ceiling, an alternative installation is shown in FIG. 10 wherein casing 2 is secured to a pivotable arm 50. The screen in the retracted state can thus be moved away to a position against a wall under, for example, a shelf.

As ceilings vary in height from 7ft to 8ft.6 inches it is envisaged that with the unit fixed direct to the ceiling above a bath or shower tray the screen will require a total drop of approximately 7ft.

The advantages resulting from the unit of the present invention are that it is relatively cheap and that when not in use, unlike a curtain, cannot be seen. Also, it is easy to install and can be decorated in any desired manner to harmonise with the surrounding decor.

I claim:

1. In the known type of shower screen unit which includes an elongated casing which is adapted to be mounted horizontally, a roller shaft rotatably mounted within the casing, one side of a generally rectangular sheet of screen material being attached to the roller shaft so that as the roller shaft is rotated, the screen material is rolled up on said shaft or unrolled from said shaft, the improvement in said combination comprising at least one freely rotatable water absorbent roller, (1) said water absorbent roller also mounted within said casing in a position parallel to said roller shaft, (2) said water absorbent roller being positioned with respect to said roller shaft so that the water absorbent roller will press against the screen material as it is retracted into the casing, whereby any water on the surface of the screen material that contacts the water absorbent roller is absorbed by the water absorbent roller as the water absorbent roller rotates with the upward movement of the screen material.

2. A shower screen unit according to claim 1, wherein the roller shaft and the screen material form part of a known roller blind assembly.

3. A shower screen unit according to claim 2, wherein a cup-shaped anti-jamming washer is freely rotatably mounted on each end of the roller shaft.

4. A shower screen unit according to claim 1, wherein the screen material is such as to not be affected by the deterious effect of any of the group including soap, water and detergents and is water impervious.

5. A shower screen unit according to claim 4, wherein a plastics material forms the screen material.

6. A shower screen unit according to claim 4, wherein woven glass fiber forms the screen material.

7. A shower screen unit according to claim 1, wherein a cylindrical section of sponge mounted on a shaft, forms said water absorbent roller.

8. A shower screen unit according to claim 7, wherein a protein free plastics material forms the said sponge.

9. A shower screen unit according to claim 1, wherein the lower edge region of the screen material is adapted to grip a wall of a shower area.

10. A shower screen unit according to claim 9, wherein the lower edge region of the screen is divided into two flaps, one flap in use engaging against one side of a wall defining part of the shower area, and the other flap engaging the other side of said wall.

11. A shower screen unit according to claim 9, wherein flexible rubber suckers provided at spaced apart locations along the lower edge region of the screen material enable the screen to be secured to a wall of a shower area.

12. A shower screen unit according to claim 1, wherein adhesive means are provided on the casing for securing the unit to a support surface, the adhesive means taking the form of a layer of sponge impregnated with adhesive resins.

13. In the known type of shower screen unit which includes an elongated casing which is adapted to be mounted horizontally, a roller shaft rotatably mounted within the casing, one side of a generally rectangular sheet of screen material being attached to the roller shaft so that as the roller shaft is rotated, the screen material is rolled up on said shaft or unrolled from said shaft, the improvement in said combination comprising two freely rotatable water absorbent rollers, (1) said water absorbent rollers mounted within said casing in positions parallel to said roller shaft, (2) said water absorbent rollers positioned with respect to said roller shaft so that the water absorbent rollers will press against opposite sides of said screen material as it is retracted into the casing, (3) said water absorbent rollers rotated in opposite directions by the upward movement of the screen material, (4) said water absorbent rollers adapted to absorb water from the surface of said screen material as the screen rises.

14. A shower screen unit according to claim 13, wherein the roller shaft and screen material form part of a known roller blind assembly.

15. A shower screen unit according to claim 14, wherein a cup-shaped anti-jamming washer is freely rotatably mounted on each end of the roller shaft.

16. A shower screen unit according to claim 13, wherein the screen material is formed from one of the group including a plastics material and woven glass fiber.

17. A shower screen unit according to claim 13, wherein a cylindrical section of sponge material mounted on a shaft forms the water absorbent roller.

18. A shower screen unit according to claim 17, wherein a protein free plastics material forms the said sponge.

19. A shower screen unit according to claim 13, wherein the lower edge region of the screen is divided into two flaps, one flap in use, engaging on one side of a wall defining part of the shower area, and the other flap engaging on the other side of said wall.

20. A shower screen unit according to claim 14, wherein adhesive means are provided on the top of the casing for securing the unit to a support surface, the adhesive means taking the form of a layer of sponge impregnated with adhesive.

21. A shower screen unit according to claim 14, wherein support brackets engage in channels in said casing, and project from the casing for use in securing the unit to a support surface.

22. A shower screen unit according to claim 13, wherein said cashing has an inverted U-shaped transverse cross-section with a number of ribs provided on its inside surface, end caps closing the ends of the casing, brackets being retained in channels formed by said ribs and said roller shaft is supported by brackets.

23. A shower screen unit according to claim 22 wherein the roller shaft and screen material form part of a known roller blind assembly.

24. A shower screen unit according to claim 23 wherein a cup-shaped anti-jamming washer is freely rotatably mounted on each end of the roller shaft.

25. A shower screen unit according to claim 22, wherein a motor is provided to roll-up or unroll the screen.

26. A shower screen unit according to claim 22, wherein a decorative valance is detachably secured to the outer surface of the front side wall of the casing.

27. A shower screen unit according to claim 1, wherein said casing is mounted on a hinged arm which enables the unit to be pivoted to an out-of-use position.

* * * * *